US010179688B2

(12) United States Patent
Miller

(10) Patent No.: US 10,179,688 B2
(45) Date of Patent: Jan. 15, 2019

(54) CONTAINER HAVING INTEGRATED APPLICATOR

(71) Applicant: L'Oreal, Paris (FR)

(72) Inventor: Zane Bowman Allen Miller, Seattle, WA (US)

(73) Assignee: L'Oreal, Paris (FR)

( * ) Notice: Subject to any disclaimer, the term of this patent is extended or adjusted under 35 U.S.C. 154(b) by 390 days.

(21) Appl. No.: 14/981,426

(22) Filed: Dec. 28, 2015

(65) Prior Publication Data

US 2017/0183142 A1 Jun. 29, 2017

(51) Int. Cl.

| | |
|---|---|
| ***B65D 81/36*** | (2006.01) |
| ***B65D 5/02*** | (2006.01) |
| ***B65D 5/42*** | (2006.01) |
| ***B65D 5/66*** | (2006.01) |
| ***A45D 40/26*** | (2006.01) |
| ***A45D 19/00*** | (2006.01) |

(52) U.S. Cl.

CPC ..... *B65D 81/368* (2013.01); *A45D 19/00* (2013.01); *A45D 40/262* (2013.01); *B65D 5/02* (2013.01); *B65D 5/4266* (2013.01); *B65D 5/6602* (2013.01)

(58) Field of Classification Search

CPC ..... B65D 81/368; B65D 5/02; A45D 19/00
USPC ..... 229/103
See application file for complete search history.

(56) References Cited

U.S. PATENT DOCUMENTS

| | | | | | |
|---|---|---|---|---|---|
| 3,765,044 | A * | 10/1973 | Hanahan | A47L 13/52 | 15/104.8 |
| 4,055,292 | A * | 10/1977 | Hosoya | B65D 5/76 | 206/229 |
| 4,887,717 | A * | 12/1989 | Secrest, Jr. | B65D 81/36 | 206/223 |
| 5,054,828 | A * | 10/1991 | Hantover | E01H 1/1206 | 15/257.1 |
| 5,186,384 | A * | 2/1993 | Nelson | E01H 1/1206 | 229/117.14 |
| 5,564,762 | A * | 10/1996 | Ring | E01H 1/1206 | 229/122 |
| 6,155,477 | A * | 12/2000 | Herrera | B65D 5/0005 | 229/101 |
| 6,402,016 | B1 * | 6/2002 | Lee | B65D 5/5206 | 206/45.21 |
| 7,150,118 | B1 * | 12/2006 | Benton | G09F 15/0062 | 40/610 |
| 9,561,890 | B2 * | 2/2017 | Denney | B65D 77/24 | |
| 2013/0167857 | A1 * | 7/2013 | DeGeorge | A45D 7/04 | 132/200 |

* cited by examiner

*Primary Examiner* — Derek Battisti
(74) *Attorney, Agent, or Firm* — Christensen O'Connor Johnson Kindness PLLC

(57) ABSTRACT

A container constructed from paperboard, card board stock, etc., includes at least one panel that is configured to be removed from the container. The panel is configured, for example, with a plurality of score lines, to enable the panel to transition from its primary configuration to a different, secondary configuration. The secondary configuration can form a handle, a stirrer or mixing stick, etc., for use with the contents of the packaging. The container can be included as part of a kit that is presented at a point of sale.

16 Claims, 11 Drawing Sheets

CONTAINER HAVING INTEGRATED APPLICATOR

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with one or more aspects of the present disclosure, a containerboard container is provided. The container comprises a container body that includes an interior cavity for receiving one or more items. The container body in some embodiments is composed of a plurality of walls, at least one wall removable from the container body. In some embodiments, the at least one wall removable from the container body is configured to be formed into a device having a configuration different than the wall once the wall is removed from the container body. The device is some embodiment is selected from a group consisting of a brush, a brush handle, and a stirrer.

In accordance with another aspect of the present disclosure, a cosmetic kit is provided. The kit comprises one or more cosmetic compositions, and a container body that includes an interior cavity configured to house the one or more cosmetic compositions. The container body in some embodiments includes a plurality of walls, at least one wall removable from the container body. In some embodiments, the at least one wall removable from the container body is configured to be formed into a device having a configuration different than the wall once removed from the container body. The device in some embodiments is selected from a group consisting of a brush, a brush handle, and a stirrer.

In accordance with another aspect of the present disclosure, a method is provided for using a containerboard container that includes a plurality of panels. The method includes detaching one panel of said plurality of panels from the container. The panel that is detached from the container is configured so as to be formed into a device having a configuration different than the panel. The device in some embodiments is selected from a group consisting of a brush, a brush handle, and a stirrer.

DESCRIPTION OF THE DRAWINGS

The foregoing aspects and many of the attendant advantages of the claimed subject matter will become more readily appreciated as the same become better understood by reference to the following detailed description, when taken in conjunction with the accompanying drawings, wherein:

FIG. 5 depicts the remaining portion of the container once the lid is removed, the remaining portion capable of being used as a mixing bowl or the like;

DETAILED DESCRIPTION

Figure 1:
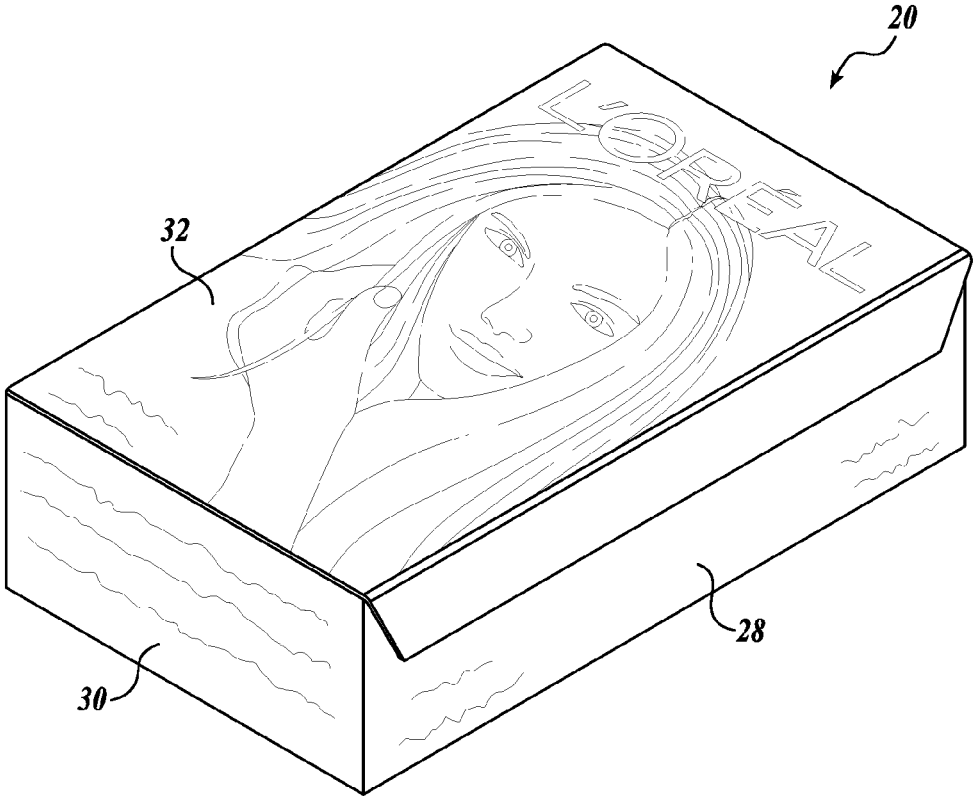
FIG. 1 is a perspective view of one representative embodiment of a container in accordance with an aspect of the present disclosure.

The detailed description set forth below in connection with the appended drawings where like numerals reference like elements is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the claimed subject matter to the precise forms disclosed.

The following discussion provides examples of consumer packaging suitable for use in the cosmetics industry, among others. The examples of the consumer packaging set forth in more detail below includes a container constructed from paperboard, card board stock, etc., having at least one panel that is configured to be removed from the container. In some embodiments, the at least one panel is the top panel or lid. In these or other embodiments, the panel is configured, for example, with a plurality of score lines, to enable the panel to transition from its primary configuration to a different, secondary configuration. The secondary configuration in some of these embodiments as discussed below form a handle, a stirrer or mixing stick, etc., for use with the contents of the packaging.

The present disclosure also includes examples of a cosmetic kit, which includes both the container and the contents of the container typically packaged together at a point of sale. In some embodiments, the kit is, for example, a hair coloring kit, which includes a plurality of tubes, packets, bottles, etc., of chemical compositions for cosmetic treatments, such as hair coloring, highlighting, etc. In some of these embodiments, two of more of the chemical compositions require mixing prior to application. For example, in some embodiments, a colorant or color cream is stored in one tube, packet, etc., and a developer is stored in another tube, packet, etc. The cosmetic kit in some embodiments also includes a brush head or the like. In some embodiments, the cosmetic kit may optionally include one or more package inserts, which can include instructions, material handling warnings, warranty information, coupons, etc. In some of these embodiments, the package insert is additionally or alternatively configured to form a device having the secondary configuration.

In the following description, numerous specific details are set forth in order to provide a thorough understanding of one or more embodiments of the present disclosure. It will be apparent to one skilled in the art, however, that many embodiments of the present disclosure may be practiced without some or all of the specific details. Further, it will be appreciated that embodiments of the present disclosure may employ any combination of features described herein. Additionally, throughout the figures, cut lines are shown as solid lines, score lines as phantom lines, and perforation lines as broken lines. Fold lines can either be score lines or perforation lines, depending on each application. Generally described, score lines, fold lines, etc., are zones or lines of weakness along which a panel can be folded.

Figure 2:
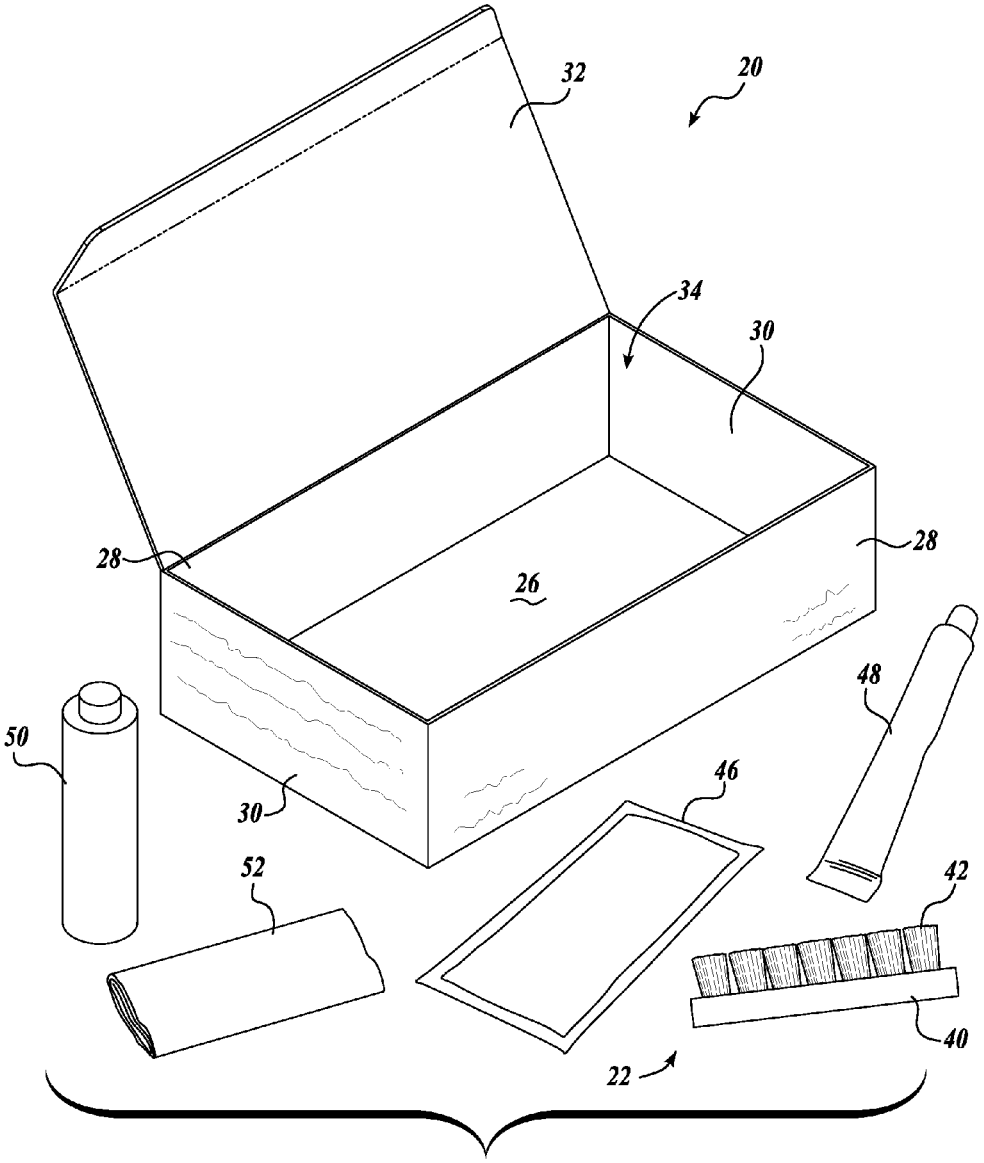
FIG. 2 depicts one representative embodiment of a cosmetic kit in accordance with an aspect of the present disclosure, the kit including the container of FIG. 1.

Turning now to FIG. 1, there is shown one example of a container, generally designated 20, formed in accordance with aspects of the present disclosure. The container 20 in one embodiment is constructed from paperboard, card board stock, etc., and is suitable for packaging one or more items for display at a point of sale. Together, the container 20 and the one or more items, generally designated 22, form a kit 24, as shown in FIG. 2. As shown in FIGS. 1 and 2, the container 20 is box-like, comprising a planar bottom wall 26, two planar, upwardly depending side walls 28, and two planar, upwardly depending end walls 30. The side walls 28 and the end walls 30 are disposed generally orthogonally to the bottom wall 26. The container 20 further includes a planar top wall 32 that forms a lid ("lid 32") of the container 20. Together, the bottom wall 26, the side and end walls 28 and 30, and the lid 32 define a cavity 34 for receiving the one or more items 22.

Figure 3A:
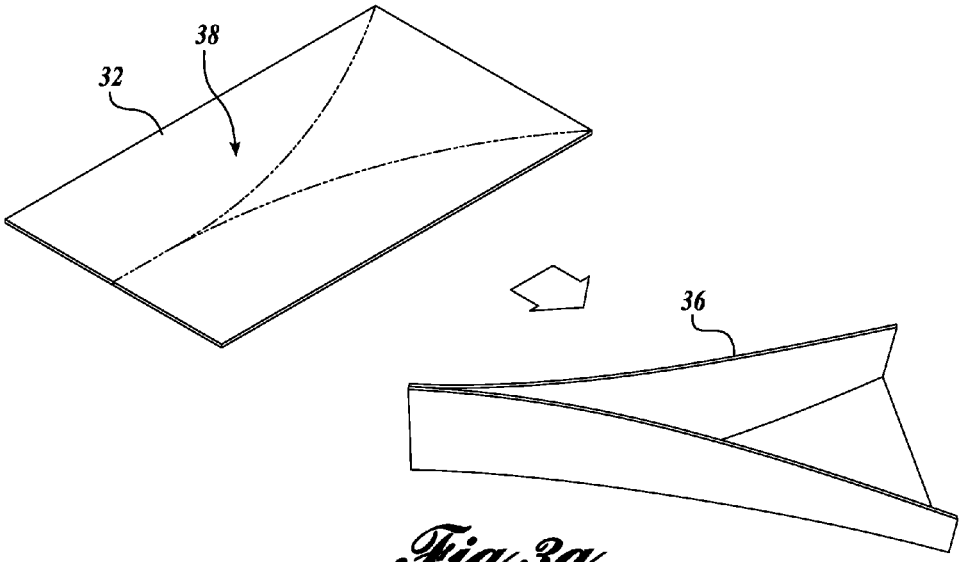
FIGS. 3*a* and 3*b* depict examples of a panel, such as the lid, of the container of FIG. 1 transitioning to a secondary configuration.
Figure 3B:
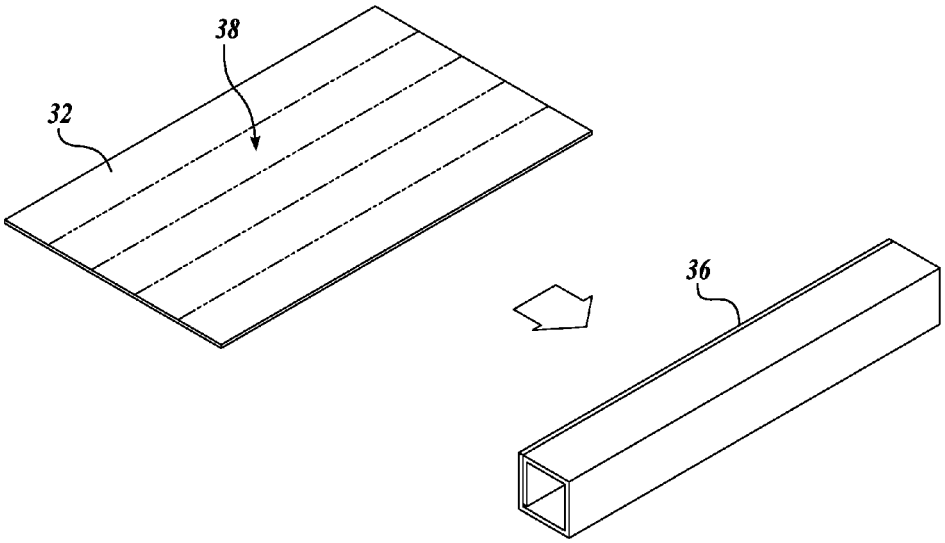
Figure 5:
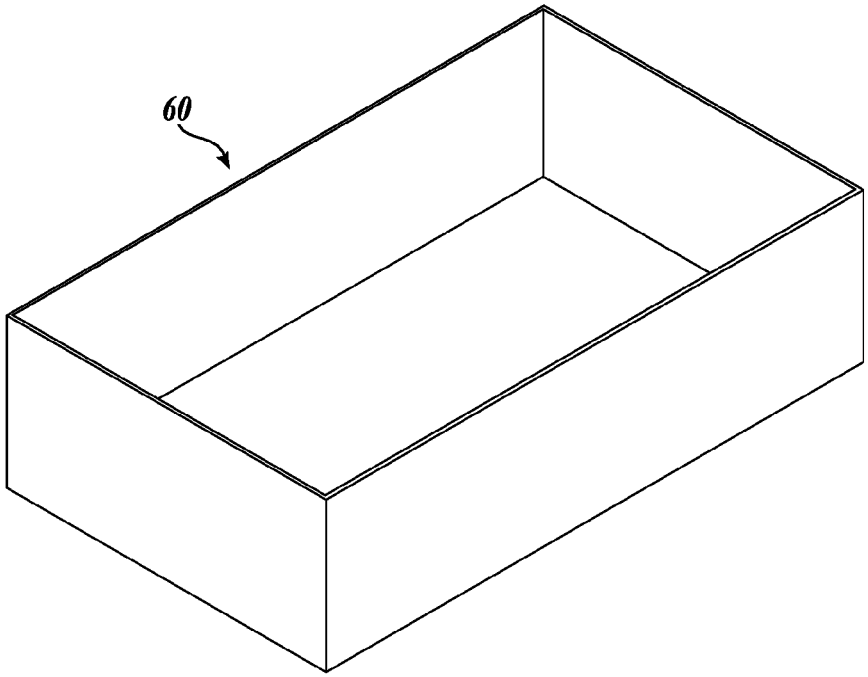

In the embodiment shown in FIGS. 1-3*b*, the lid 32 is configured for easy removal from the remainder of the container 20. In one embodiment, perforations, enlarged slots, reduced material cross-section, or other means for promoting the separation of the lid 32 from the container 20 is provided. Additionally, the lid 32 is configured to be utilized with at least one of the items 22 packaged within the container 20. In one embodiment, the lid 32, once removed from the container 20, can be transformed from its primary configuration as a lid 32 into a different, secondary configuration, generally designated 36, such as brush handle, a stirrer or mixing stick, etc., as shown in FIGS. 3*a* and 3*b*, respectively. In some embodiments, the lid 32 includes hinged sections, foldable sections, score lines, or other suitable means 38 for promoting the transition to or forming the secondary configuration 36. It will be appreciated that in some embodiments, additional flaps, panels or other container structure can be removed from the lid 32, if desired. Once the lid 32 is removed, the remaining portion 60 of the container 20 can be optionally used as a mixing tray or the like, as shown in FIG. 5.

While the lid 32 is shown in the embodiments as being configured to transition into a brush handle, a stirrer, and/or the like, it will be appreciated that the bottom wall 26 or one or more of the side or end walls 28 and 30 can be additionally or alternatively configured to transition into the secondary configuration 36 in order to carry out the same or similar functionality.

Figure 4:
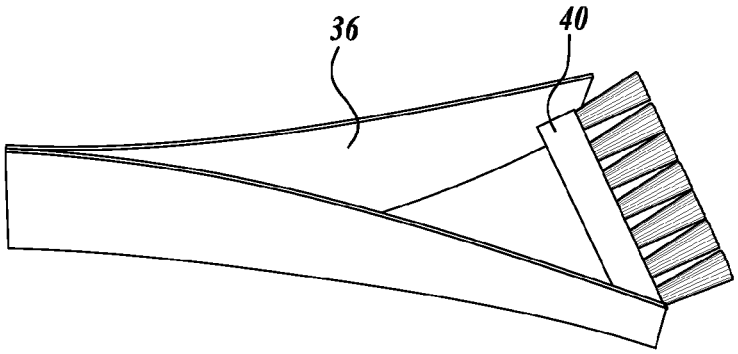
FIG. 4 is one representative embodiment of a brush constructed out of a container panel and a brush head.
Figure 6A:
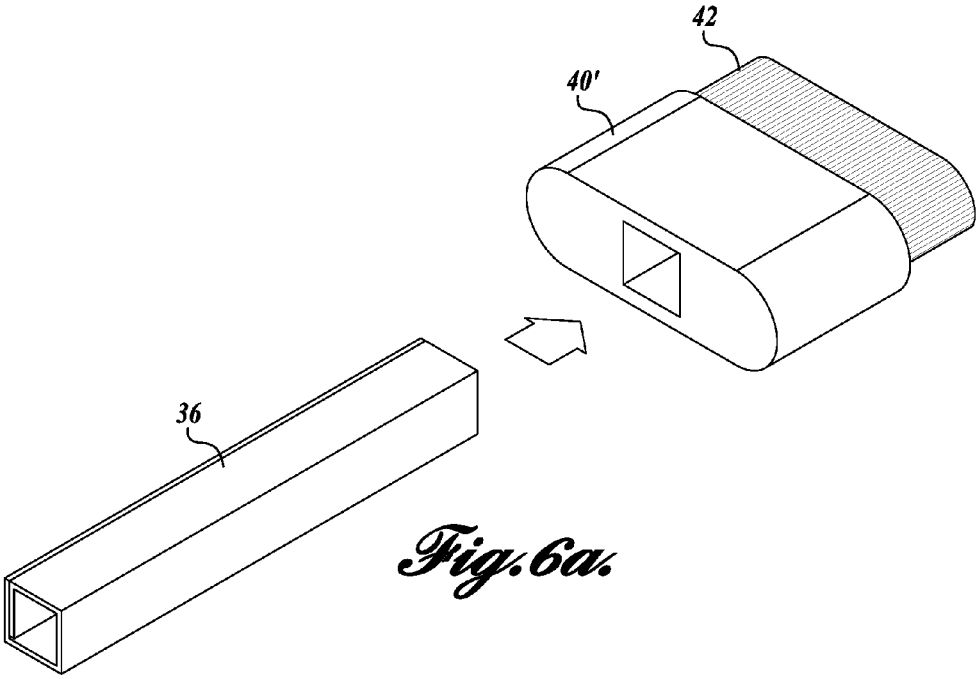
FIGS. 6*a* and 6*b* depict assembly techniques for additional embodiments of the brush.
Figure 6B:
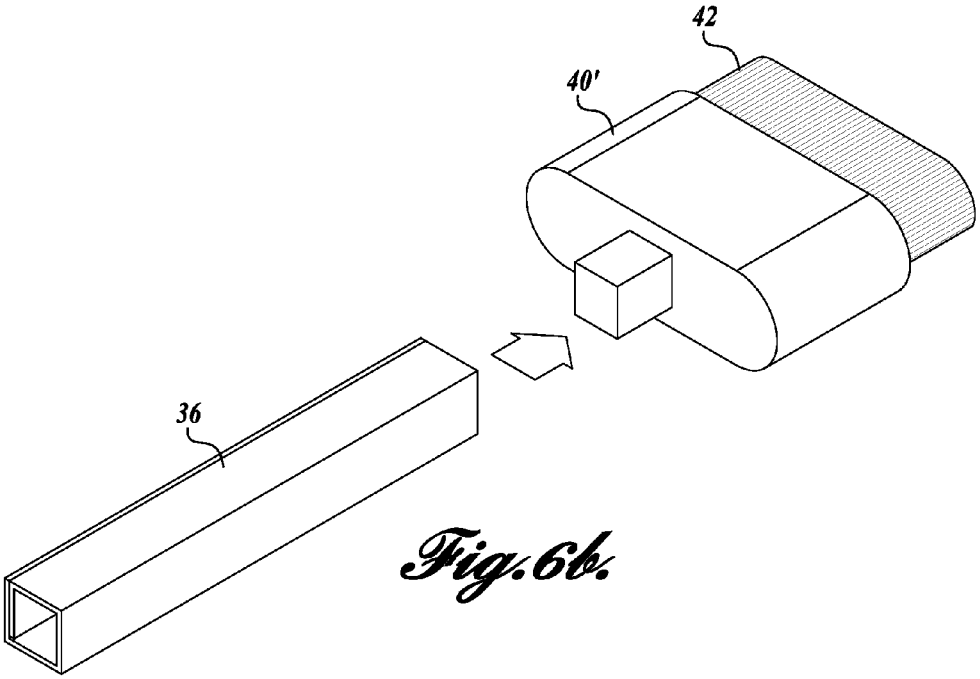

Referring now to FIG. 2, the container 20 and the one or more items 22 packaged with the container 20 can be provided together as a cosmetic kit 24. In some embodiments, the one or more items 22 are packaged within the container 20 and include a brush head 40 having a plurality of bristles 42. In one embodiment, the brush head 40 is configured to be coupled to the brush handle 36 for use therewith. In some embodiments, either the brush handle 38 or the brush head 40 can include adhesive or other means for fastening the brush head 40 to the brush handle 36, as shown in FIG. 4. In other embodiments, the brush head 40' is cooperatively configured to be coupled to the brush handle 36, as shown in FIGS. 6*a* and 6*b*.

Additionally or alternatively, the one or more items 22 packaged in the container 20 can include, for example, packets 46, tubes 48, bottles 50, etc., containing chemical compositions for a particular cosmetic treatment. In some embodiments, an empty bottle can be included, for dispensing the contents of the one of the packets, tubes, etc., during the cosmetic treatment. In some embodiments, the one or more items 22 optionally includes one or more package inserts 52, which can include instructions, material handling warnings, warranty information, coupons, etc. In some embodiments, the package insert 52 can be configured to form the secondary configuration 36 (e.g., bush handle, stirrer, etc.).

An embodiment of the container 20 includes a single piece blank 120 of foldable material arranged to form a container 20. Specific details of the blank 120 are described with more particularity below.

Figure 7:
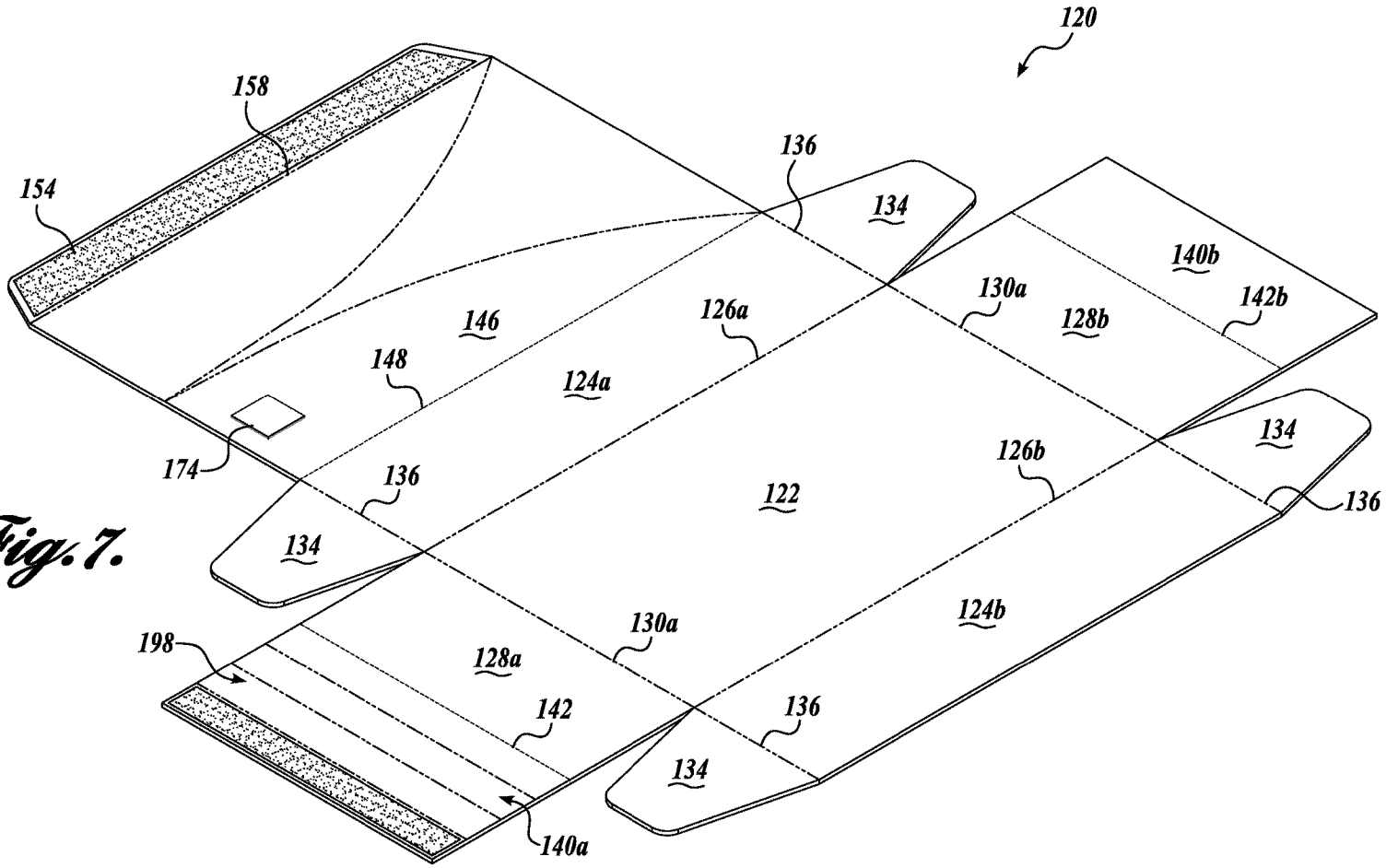
FIG. 7 is a blank suitable for erecting the container of FIG. 1.

FIG. 7 depicts one example of a blank 120 used to form the container 20 of FIG. 1. The blank 120 is preferably constructed from a single piece of formable material such as, without limitation, one or more sheets of cellulose-based materials. Cellulose-based materials used in this present disclosure come in many forms such as paperboard, card stock, etc., and will be generally referred to herein as "containerboard." The blank 120 is cut and scored, perforated or otherwise formed to include a plurality of panels that when assembled form container 20.

As shown in FIG. 7, the blank 120 includes a generally rectangular bottom panel 122. Opposed side panels 124*a* and 124*b* are hingedly connected to the bottom panel 122 via uninterrupted fold lines 126*a* and 126*b*, respectively, and opposed end panels 128*a* and 128*b* are hingedly connected to the bottom panel 122 via uninterrupted fold lines 130*a* and 130*b*, respectively. As depicted in FIG. 7, fold lines 126 are substantially perpendicular to fold lines 130. The intersection of the respective fold lines 126 and 130 substantially define the corners of the bottom panel 122. When erected, as will be described in more detail below, the bottom wall panel 122, the side wall panels 124*a* and 124*b*, and the end wall panels 128*a* and 128*b* form the bottom wall 26, the side walls 28, and the end walls 30, respectively, as shown in FIG. 1.

In the embodiment shown, side panels 124 are generally rectangular in shape. The length of the side panels 124 measured along fold line 126 are substantially equal to the length of the bottom panel 122 measured along the same fold lines. Similarly, end panels 128 are generally rectangular in shape. The length of the end panels 128 measured along fold lines 130 are substantially equal to the length of the bottom panel 122 measured along the same fold lines. It will be appreciated that the lengths and widths of the panels can vary in embodiments of the disclosure in order to alter the final dimensions of the container 20.

Figure 8:
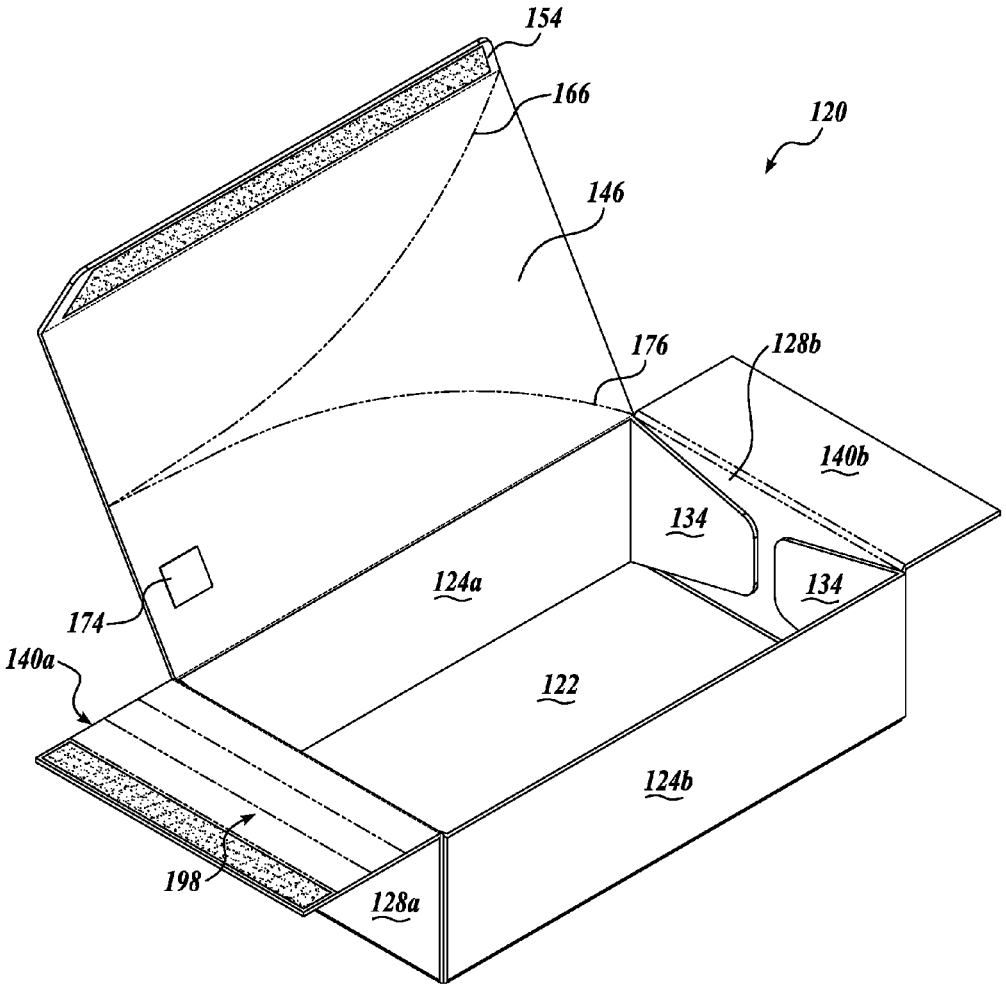
FIG. 8 is a perspective view of a container erected from the blank of FIG. 7 with the top panel in its open position.

In the embodiment shown, the side wall panels 124 include side flaps 134, which are hingedly connected to opposed sides of each side wall panel 124 along fold lines 136. The fold lines 136 are substantially perpendicular to the fold line 126. When erect, the flaps 134 are folded 90 degrees and secured to the inner surface of end panels 128 via any conventional manner, such as being stitched or glued, to form the corners of the container 20, as shown in FIG. 8. In some embodiments, the side flaps 134 may be formed with a slight taper. In other embodiments, the side flaps 134 can be hingedly connected to the sides of each end panel 128 instead. It will be appreciated that the blank 120 may include additional flaps, tabs, etc., as known in the art, for providing suitable structure that can be secured to one of the bottom, side, end, or top panels in order to erect the container 20.

Still referring to the blank 120 of FIG. 7, the end wall panels 128 include end flaps 140, which are hingedly connected to the outer ends of end wall panels 128 along fold lines 142. The fold lines 142 are substantially parallel to the fold line 130. A top panel 146 is hingedly connected to the outer end of one of the side panels 124, shown as side panel 124*a*, about fold line 148. The fold line 148 is substantially parallel to the fold line 126*a*. When erected, as will be described in more detail below, the top wall panel 146 forms the lid 32 of the container 20, as shown in FIG. 1.

In the embodiment shown, the top wall panel 146 includes an end flap 154, which is hingedly connected to the outer end of the top wall panel 146 along fold line 158. The fold line 158 is generally parallel to the fold lines 148 and 126*a*. When erect, the end flap 154 can be bent 90 degrees to cooperate with the opposite side wall 24 in order to secure the lid 32 in the closed position, as shown in FIG. 1. In some embodiment, portions of the side wall panel 124B adjacent its outer edge may include glue, an adhesive strip, etc., in order to secure the end flap 154 to the side wall panel 124*b* when the container is erected and the top wall panel 146 is in the closed position. It will be appreciated that the fastening means (e.g., glue, an adhesive strip, etc.) can be positioned so as to either secure the end flap 154 to either the exterior or interior surface of the side wall panel 124*b*. In another embodiment, it will be appreciated that an end flap, similar to end flap 154, can be additionally or alternatively provided on sidewall panel 124*b*.

As shown in FIG. 7, the top panel 146 includes a plurality of score lines, shown as score lines 166 and 170, and the fold line 148 is a perforation line for easy removal of the top wall panel 146 from the remainder of the container blank 120. In the embodiment shown in FIG. 7, the score lines 166 and 170 are curved. Each curved score line starts at the corners of the top wall panel and curves toward the middle of the top wall panel as they both extend toward the opposite end thereof. At a point along the center line of the top wall panel 146, the score line 166 is coincident with the other score line 170. In another embodiment shown in FIG. 9*b*, the score lines 166 and 177 do not intersect but instead curve symmetrically about the center line of the panel as they extend to the opposite end thereof. Other score line configurations are possible. In some embodiments, the plurality of score lines can include a number of evenly spaced, parallely disposed score lines, such as the pattern of score lines shown in FIG. 3*b*.

Once removed, the top wall panel 146 in some embodiments can be folded about the score lines 166 and 170 in order to form the brush handle 36, as shown in FIG. 3*a*. As such, the score lines 166 and 170 form one embodiment of the means 38 for promoting the transition to or forming the secondary configuration or brush handle 36. In these embodiments and others, portions of the top wall panel can optionally include an adhesive strip, glue, or other fastening means 174 dispersed on the back surface thereof so that the top panel section can maintain the configuration of the brush handle of FIG. 4 when folded. A brush head, such as the brush head 40, may then be attached along the edge of the newly formed brush handle 38 via suitable fastening means, such as glue, adhesive strips, and/or the like.

Figure 9A:
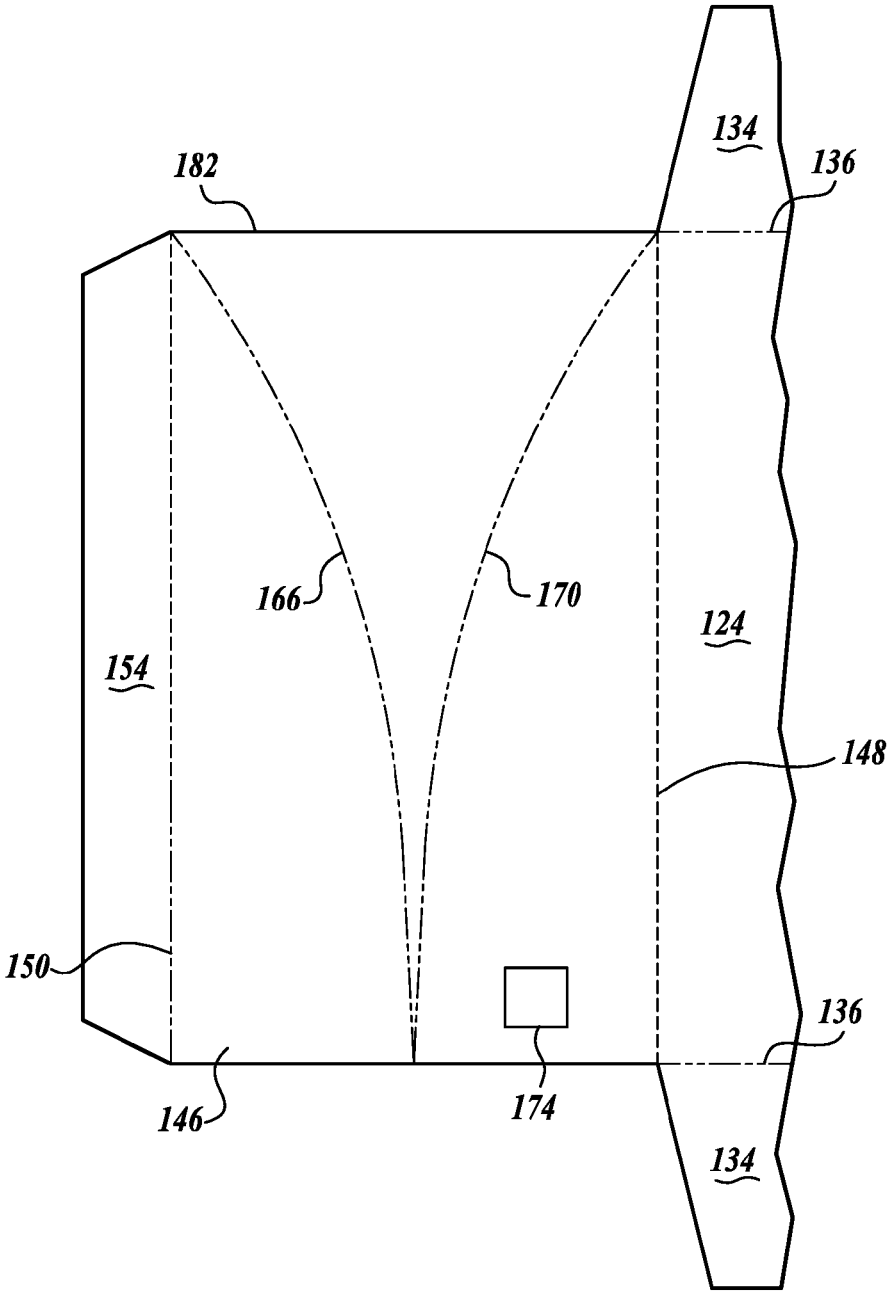
FIGS. 9*a* and 9*b* are partial plan views of a blank showing alternative embodiments of the top panel formed in accordance with an aspect of the present disclosure.
Figure 9B:
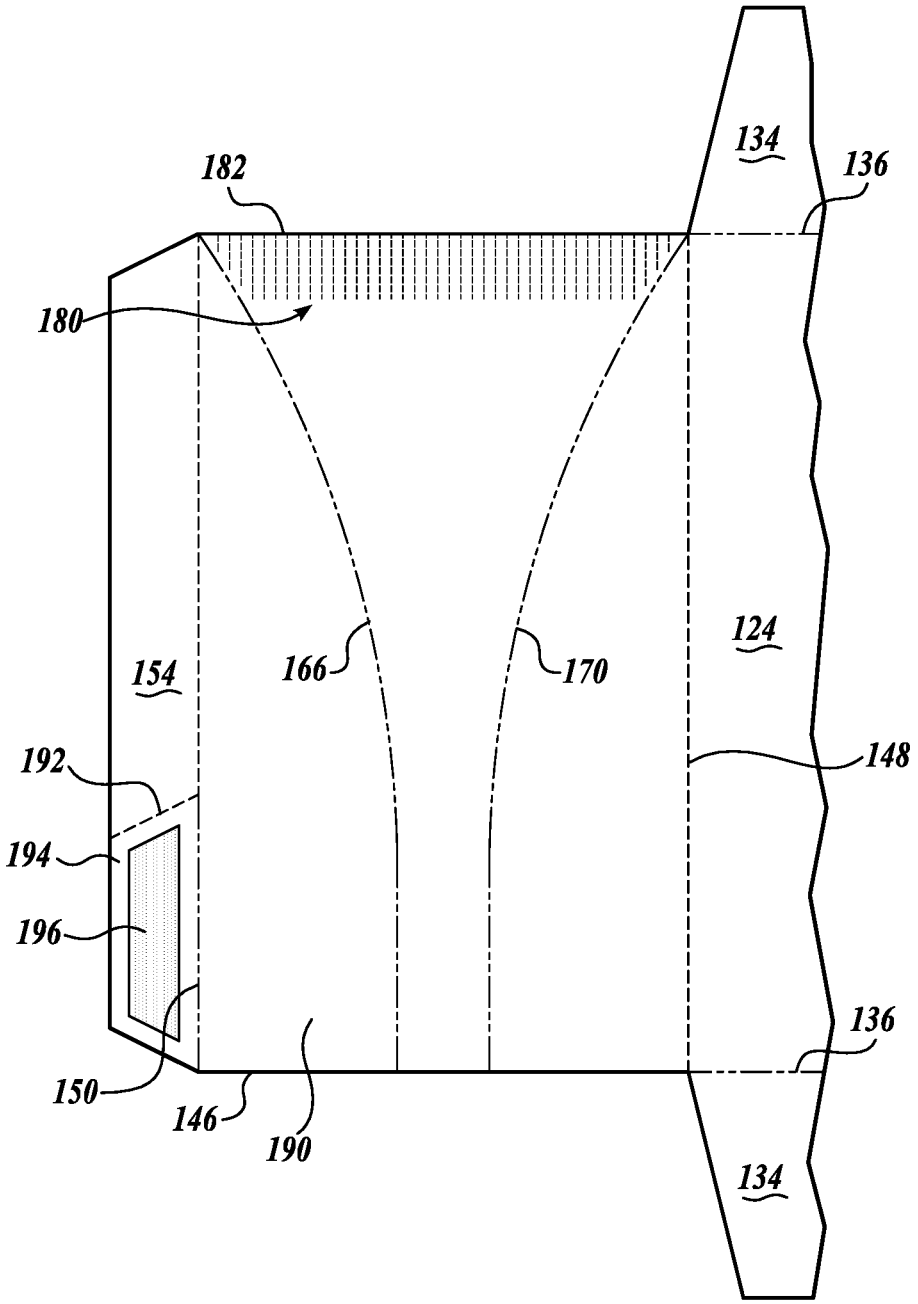

In another embodiment shown in FIG. 9*b*, the top wall panel 146 can include a plurality of perforation lines 180 that are evenly spaced apart and extend parallel with the perforation line 148. In this embodiment, the plurality of perforation lines 180 extends inwardly from the edge 182 approximately 0.25 inches or more. In this embodiment, when torn along the perforation lines 180, strip sections are formed, which can be used to form bristle-like members of a brush. In this embodiment, a separate brush head can be omitted from the cosmetic kit, if desired.

In the embodiment of FIG. 9*b*, the end flap 154 can also be employed to fasten together the top panel sections 188 and 190 when the top side panel 146 is transformed into the secondary configuration or brush handle 36. In that regard, the end flap 154 may include a perforation line 192, which together with a portion of fold line 150 forms a tab section 194. The tab section 194 can optionally include an adhesive strip, glue, or other fastening means 196 in order to fasten the top panel sections 188 and 190 together once the other part of the end flap 154 is removed.

Figure 10A:
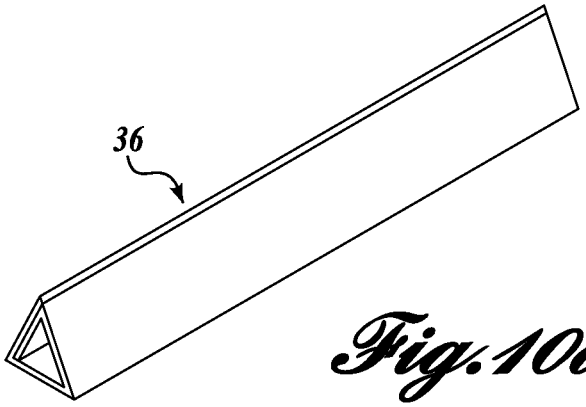
FIGS. 10*a*-10*g* are various embodiments of a container panel transitioned to the secondary configuration.
Figure 10B:
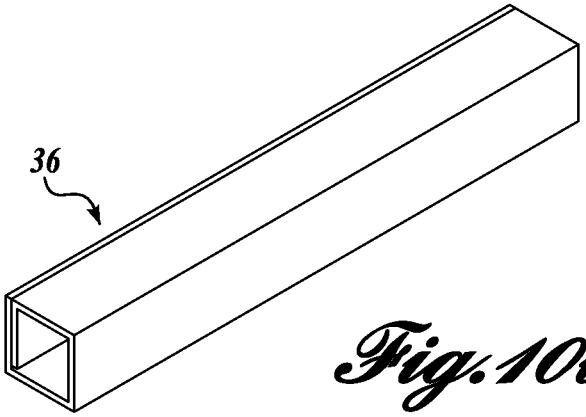
Figure 10C:
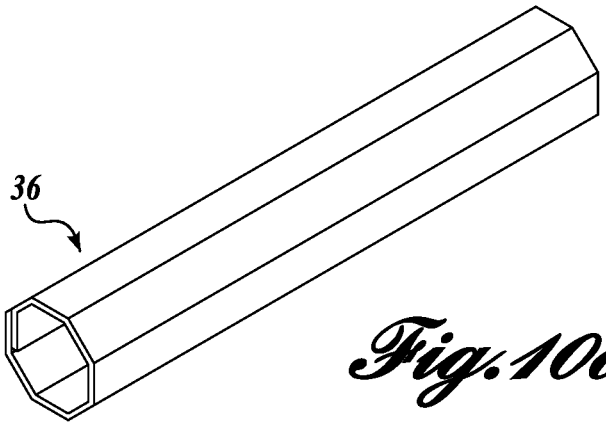
Figure 10D:
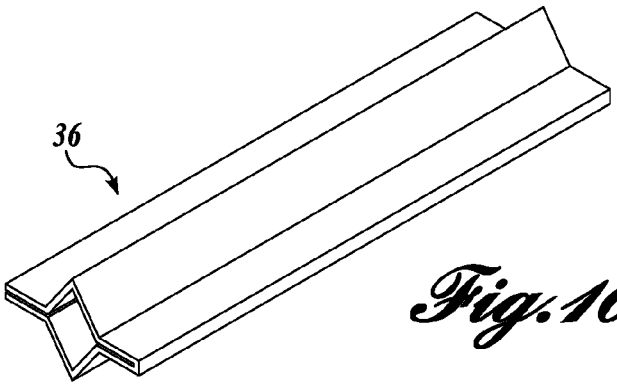
Figure 10E:
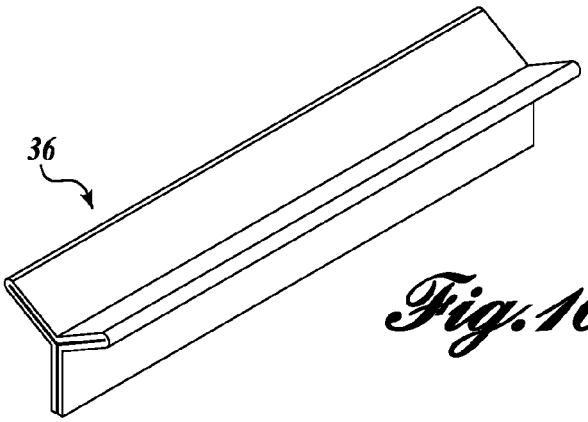
Figure 10F:
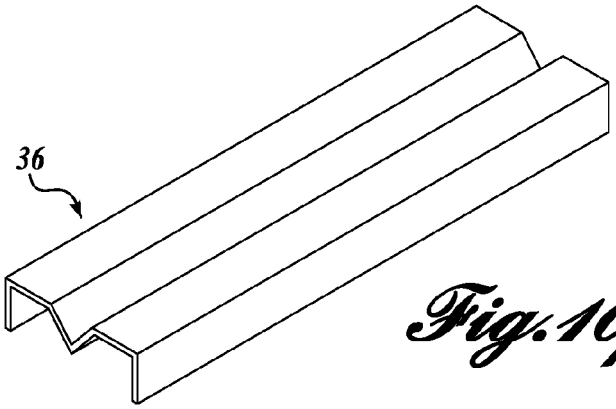
Figure 10G:
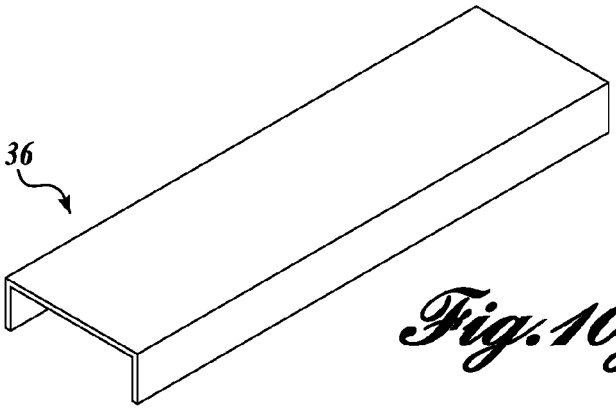

In one embodiment, one or both of the end flaps 140 can optionally include a plurality of score lines 198, as shown in FIG. 7. As shown in the embodiment of FIG. 7, the score lines 198 are evenly spaced apart and parallel to the fold line 142*a*. In this embodiment, the fold line 142*a* can be a perforation line so that the end flap 140*a* can be easily removed from remainder of the container 20. Once removed, the end flap 140*a* can be folded about each of its score lines 198, thereby forming another embodiment of a brush handle, a stirrer, mixing stick, or the like. It will be appreciated that the end flap 140 can include three score lines for forming a brush handle 36 with a triangle cross-section as shown in FIG. 10*a*, or can contain four score lines for forming a rectangular cross-section, as shown in FIG. 10*b*. Other cross sections can be practiced with embodiments of the present disclosure, and depend on the number of score lines. Some of these embodiments are shown in FIGS. 10*c*-10*g*. In these embodiments, one of the edge flap sections optionally includes an adhesive strip or glue dispersed thereon for securing the edge flap sections together so that the flap section can maintain the configuration of FIGS. 10*a*-10*e*.

It should be noted that for purposes of this disclosure, terminology such as "upper," "lower," "vertical," "horizontal," "inwardly," "outwardly," "inner," "outer," "front," "rear," etc., should be construed as descriptive and not limiting the scope of the claimed subject matter. Further, the use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

The embodiments of the invention in which an exclusive property or privilege is claimed are defined as follows:

1. A containerboard container, comprising:

a container body that includes an interior cavity for receiving one or more items, the container body composed of a plurality of walls, at least one wall removable from the container body, the at least one wall configured to be formed into a device having a configuration different than the wall once removed from the container body, wherein the device is a brush, and wherein the at least one wall includes a plurality of perforation lines that extend inwardly from an edge of the at least one wall and that when torn along the plurality of perforation lines form bristle members of the brush.

2. The container of claim 1, wherein the container body is formed by a containerboard blank, the blank comprising a plurality of panels configured to form said plurality of walls of the container body when erected, wherein the plurality of panels includes:

a rectangular bottom panel;

first and second side wall panels hingedly connected to first and second sides of the bottom panel;

first and second end wall panels hingedly connected to first and second ends of the bottom panel;

a top panel hingedly connected to one of said first and second side wall panels and first and second end wall panels, wherein one of said plurality of panels includes a plurality of score lines configured and arranged such that one of said plurality of panels can be folded about the plurality of score lines in order to form said device.

3. The container of claim 2, wherein another of said plurality of panels includes a plurality of score lines configured and arranged such that said another panel can be folded about the plurality of score lines in order to form another portion of said device.

4. The container of claim 3, wherein said one of said plurality of panels and said another of said plurality of panels are hingedly connected by a perforation line.

5. The container of claim 1, wherein the at least one wall is a lid hingedly connected to the container body.

6. The container of claim 5, further comprising means for promoting separation between the lid and the container body.

7. The container of claim 5, wherein the lid includes means for promoting transition into said device.

8. The container of claim 1, wherein the at least one wall includes a plurality of score lines configured to promote transition into said device.

9. A cosmetic kit, comprising:

one or more cosmetic compositions; and a container body that includes an interior cavity configured to house the one or more cosmetic compositions, the container body including a plurality of walls, at least one wall removable from the container body, the at least one wall configured to be formed into a device having a configuration different than the wall once removed from the container body, wherein the device is a brush, and wherein the at least one wall includes a plurality of perforation lines that extend inwardly from an edge of the at least one wall and that when torn along the plurality of perforation lines form bristle members of the brush.

10. The kit of claim 9, wherein the one or more cosmetic compositions are contained in a structure selected from the group consisting of a bottle, a packet, and a tube.

11. The kit of claim 9, wherein the at least one wall includes a plurality of score lines configured to promote transition to said device.

12. A method of using a containerboard container that includes a plurality of panels, comprising:

detaching one panel of said plurality of panels from the container, said panel detached from the container being configured so as to be formed into a device having a configuration different than the panel, wherein the device is a brush, and wherein the at least one panel of the plurality of panels includes a plurality of perforation lines that extend inwardly from an edge of the at least one panel and that when torn along the plurality of perforation lines form bristle members of the brush.

13. The method of claim 12, further comprising forming said device from the detached panel.

14. The method of claim 12, further comprising applying a chemical composition with the bristle members of the brush.

15. The method of claim 13, further comprising mixing two or more chemical compositions in the container with said device.

16. The container of claim 9, wherein another of said plurality of walls includes a plurality of score lines configured and arranged such that said another wall can be folded about the plurality of score lines in order to form another portion of said device.

* * * * *